US005289198A

United States Patent [19]

Altshuler

[11] Patent Number: 5,289,198

[45] Date of Patent: Feb. 22, 1994

[54] DOUBLE-FOLDED MONOPOLE

[75] Inventor: Edward E. Altshuler, Newton, Mass.

[73] Assignee: The United States of America as represented by the Secretary of the Air Force, Washington, D.C.

[21] Appl. No.: 934,050

[22] Filed: Aug. 21, 1992

[51] Int. Cl.[5] ..... H01Q 9/44; H01Q 21/24

[52] U.S. Cl. ..... 343/729; 343/730; 343/802; 343/828; 343/829

[58] Field of Search ..... 343/802-804, 343/749, 826, 828, 797, 810, 829, 729, 730, 731; H01Q 21/24, 21/26, 9/16, 9/26, 9/40, 9/42, 9/44

[56] References Cited

U.S. PATENT DOCUMENTS

| | | | |
|---|---|---|---|
| 2,485,138 | 10/1949 | Carter | 343/803 |
| 2,533,529 | 12/1950 | Spindler | 343/803 |
| 2,702,347 | 2/1955 | Spindler | 343/803 |
| 3,875,572 | 4/1975 | Kay | 343/803 |
| 3,952,310 | 4/1976 | Griffee et al. | 343/730 |
| 4,423,423 | 12/1983 | Bush | 343/803 |
| 4,629,978 | 12/1986 | Aslan | 324/95 |

FOREIGN PATENT DOCUMENTS

| | | | |
|---|---|---|---|
| 1-82806 | 3/1989 | Japan | H01Q 21/24 |

*Primary Examiner*—Michael C. Wimer

*Attorney, Agent, or Firm*—William G. Auton; Donald J. Singer

[57] ABSTRACT

A double-folded monopole is used on a linear antenna to produce a traveling-wave distribution of current. The double fold is positioned one-quarter wavelength from the end of the antenna. The resultant antenna has three radiating elements that are orthogonal with respect to each other. The orthogonal folded dipoles each consist of five segments designed so that the currents have comparable magnitudes and are in phase to provide near hemispherical coverage.

6 Claims, 3 Drawing Sheets

DOUBLE-FOLDED MONOPOLE

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to antennas, and more specifically the invention pertains to a double-folded monopole for use on a linear antenna to produce a traveling-wave distribution of current.

Probably the most widely used antenna for both transmission and reception is a monopole above a ground plane. It may be used either alone or as an element of an array from kilohertz frequencies up through the microwave band. It is a simple and very inexpensive antenna. It radiates (or receives) a vertically polarized field. It provides 360° coverage in azimuth; elevation coverage is limited by the size and the conductivity of the ground plane. For an infinite, perfectly conducting ground plane the elevation pattern of the monopole has a peak along the horizon. As the ground plane becomes smaller the elevation angle of the peak field rises; there is always a null in the zenith direction.

One of the main limitations of the monopole is that it is a relatively narrow band antenna; that is its input impedance and directional properties are a strong function of frequency. The bandwidth of this type antenna can be significantly increased by placing a resistance of suitable magnitude one-quarter wavelength from its end point. This was called the "Traveling-Wave Linear Antenna" since it has a traveling wave distribution of current up to the resistor.

The main disadvantage of the resistive-loaded traveling-wave antenna is that it is only about 50% efficient because part of the input power is absorbed by the resistor. The double-folded monopole evolved from this traveling-wave linear antenna. The approach was to replace the resistor with a resonant antenna which has a radiation resistance that is approximately equal to that of the matching resistor. Thus the inserted antenna would be driven by the other antenna. The input section will still have a traveling-wave distribution of current up to the inserted element, as before, but now the power that was previously dissipated in the resistor is also radiated. There are many types of antennas that can be used in place of matching resistor. The only constraint is that if the traveling-wave distribution of current on the input section is to be preserved, then the radiation resistance of the inserted antenna should be approximately 240 ohms and the element should be placed one-quarter wave length from the end of the monopole. Another option is to insert antenna elements at distances of odd multiples of quarter wavelengths from the end of the monopole. For this arrangement the radiation resistances have to be adjusted accordingly.

As mentioned above, it has been shown that a traveling-wave distribution of current can be produced on a linear antenna by inserting a resistance of suitable magnitude one-quarter wavelength from its end. The electrical energy used up by this resistance is dissipated in useless thermal energy.

The task of maintaining a traveling wave distribution of current radiated by a linear antenna and minimizing the loss of energy is not dealt with by the following U.S.

Patents, the disclosures of which, are specifically incorporated herein by reference:

U.S. Pat. No. 3,875,572 issued to Kay;

U.S. Pat. No. 3,952,310 issued to Griffee et al.;

U.S. Pat. No. 4,423,423 issued to Bush; and

U.S. Pat. No. 4,629,978 issued to Aslan.

The patents identified above relate to antenna devices including dipole apparatus. In particular, the Kay patent describes a broad band antenna having a folded dipole including first and second open center portions, and transmission line feed points are located at the opposite sides of the second open center portion. The transformer element electrically lengthens the antenna into a half-wave folded dipole antenna for the reception of low-band signals, while simultaneously electrically opening the antenna into a full-wave dipole antenna for high-band reception.

The Griffee et al. patent is directed to a crossed dipole antenna apparatus configured with the ends of the adjacent dipoles connected together to form a version of folded dipole antenna wherein there are slot antennas between adjacent dipole antennas. The combination slot and dipole antennas provides broadband usable frequency range with acceptable radiation patterns.

The Bush patent relates to a folded dipole antenna comprising two conducting wires with each wire folded back over itself in a spaced parallel relationship. The ends of the folded wires are arranged so that like ends oppose each other. A load balancing means joins one set of the opposing ends of the folded conducting wires, and a load matching means connects the remaining set of opposing ends through the matching means to a radio frequency generator.

The Aslan patent describes a dipole antenna device comprising three mutually orthogonal antenna assemblies. Each antenna assembly includes an array of resistive thermocouples extending along a longitudinal axis. Within each assembly, conductive elements of discrete length extend transverse to their respective array, and are connected between each resistive thermocouple. The spacing between the conductive elements is approximately one-half wavelength of the mid-frequency of the range for which the antenna is designed.

Although these patents relate to antenna devices with dipole apparatus, they do not describe a dipole antenna where the orthogonal folded dipoles each consist of five segments designed so that the current have comparable magnitudes and are in phase quadrature to provide near hemispherical coverage.

While the above-cited references are instructive, a need remains to produce a dual polarized antenna that provides near hemispherical coverage and is driven from a single input. The present invention is intended to satisfy that need.

SUMMARY OF THE INVENTION

The present invention includes a double folded monopole antenna. The antenna elements include a ground plane; a monopole stud with a center axis and a first end projecting through the ground plane and a second end which projects out perpendicularly from said ground plane, and double fold radiating elements which are electrically connected and fixed to said monopole stud about one-quarter wavelength from the second end of the monopole stud. Note that the double folded monopole can be either series fed, or parallel fed. The double fold radiating elements comprise a first and second V-shaped radiating fold which have the points of their V-shapes in contact with each other so that the first and second V-shaped radiating folds form a double folded shape that resembles an "X" with the "X" having a center aligned with the center axis of the monopole stud. The double fold elements are positioned one-quarter wavelength from the end of the antenna. The resultant antenna has three radiating elements that are orthogonal with respect to each other. The orthogonal folded dipoles each consist of five segments designed so that the currents have comparable magnitudes and are in phase quadrature to provide near hemispherical coverage. The double fold radiating elements project out about one-quarter wavelength from the center axis of the monopole stud, and may actually be formed from bends and folds made in the single antenna wire which makes up the antenna stud. The double fold radiating elements may be also be formed from metal or dielectric foil which is electrically and physically connected to the monopole stud.

The monopole stud may be formed from antenna wire and projected about one-half wavelength from the ground plane.

The object of this invention is to produce a dual polarized antenna that provides near hemispherical coverage and is driven from a single input.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes a double-folded monopole for use on a linear antenna to produce a traveling-wave distribution of current. The double fold is positioned one-quarter wavelength from the end of the antenna. The resultant antenna has three radiating elements that are orthogonal with respect to each other. The orthogonal folded dipoles each consist of five segments designed so that the currents have comparable magnitudes and are in phase quadrature to provide near hemispherical coverage.

Figure 1A:
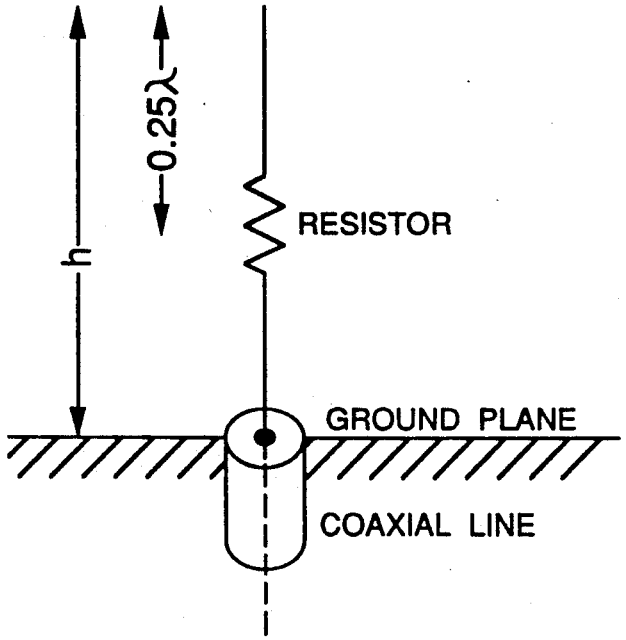
FIG. 1A PRIOR ART
FIG. 1A is a diagram of a prior art resistive loaded monopole.

The reader's attention is now directed towards FIG. 1A which is an illustration of a resistive loaded monopole antenna. As mentioned above, it has been shown that a traveling-wave distribution of current can be produced on a linear antenna by inserting a resistance of suitable magnitude one-quarter wavelength from its end. For this invention the resistor is replaced with a modified double-folded dipole which has a radiation resistance that is approximately equal to that of the matching resistor. Thus the input section has a traveling wave distribution up to the inserted antenna, as before, but now the power that was previously dissipated in the resistor is also radiated.

In general, the horizontally polarized patterns of this antenna are similar to those of crossed horizontal dipoles over a ground plane and the vertically polarized patterns are similar to those of a monopole over a ground plane. Coverage is also obtained in the zenith direction as long as the folded element is not an integral number of half wavelengths above the ground plane. The peaks and nulls can be controlled by adjusting the monopole height accordingly and it may be possible to achieve near hemispherical coverage for both polarizations. Other types of antennas to be inserted in place of the resistor are also considered.

Figure 1B:
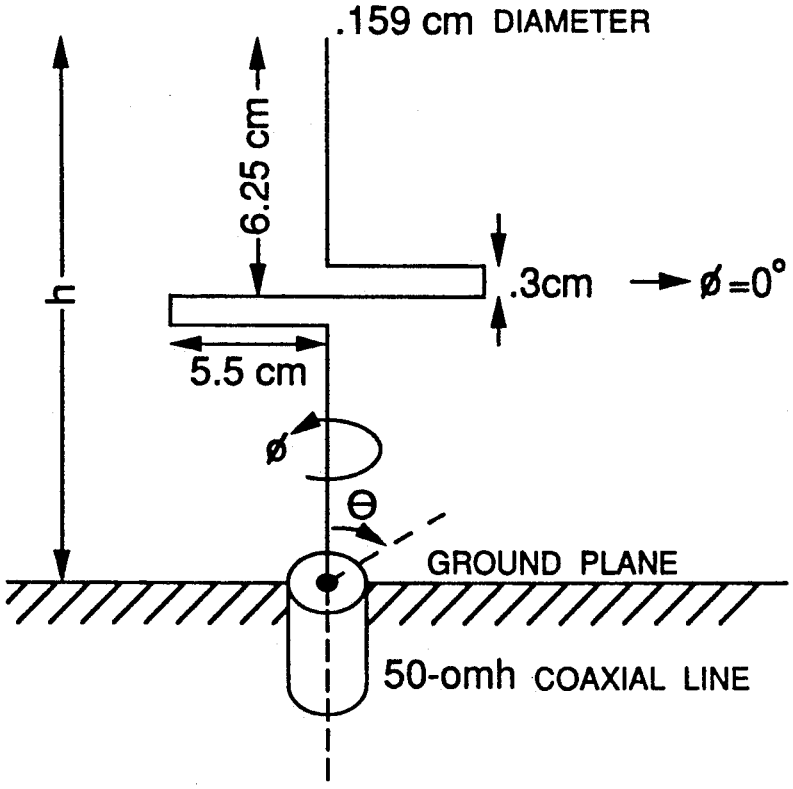
FIG. 1B is a diagram of a monopole antenna loaded with a a modified folded dipole; .
Figure 2:
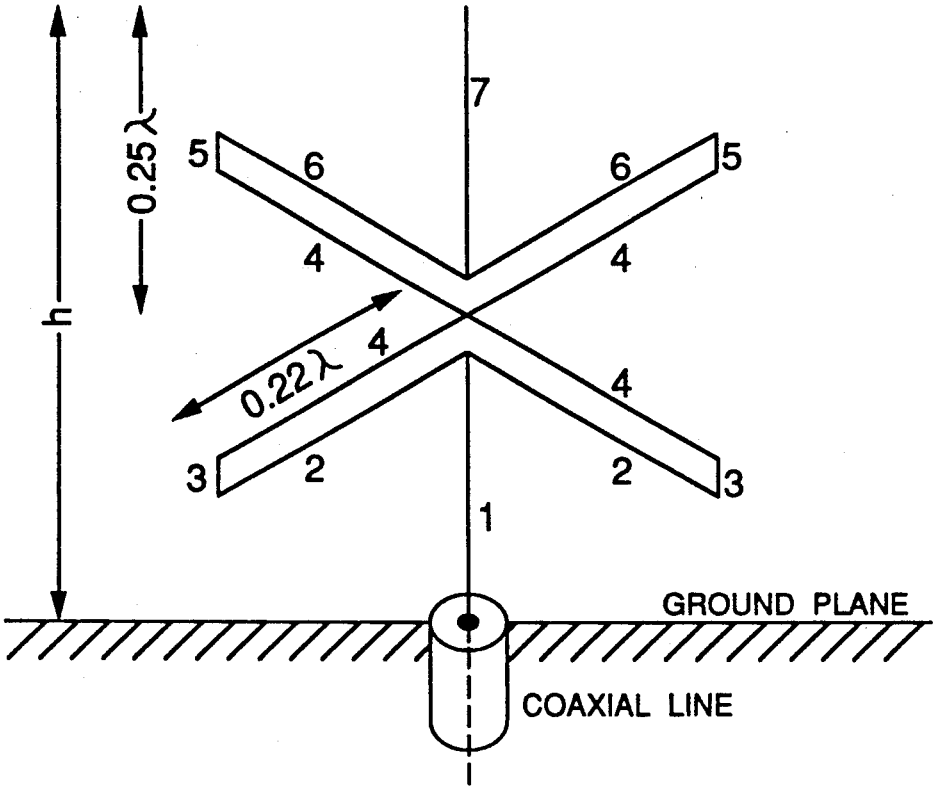
FIG. 2 is an illustration of a parallel-fed double folded monopole.
Figure 3:
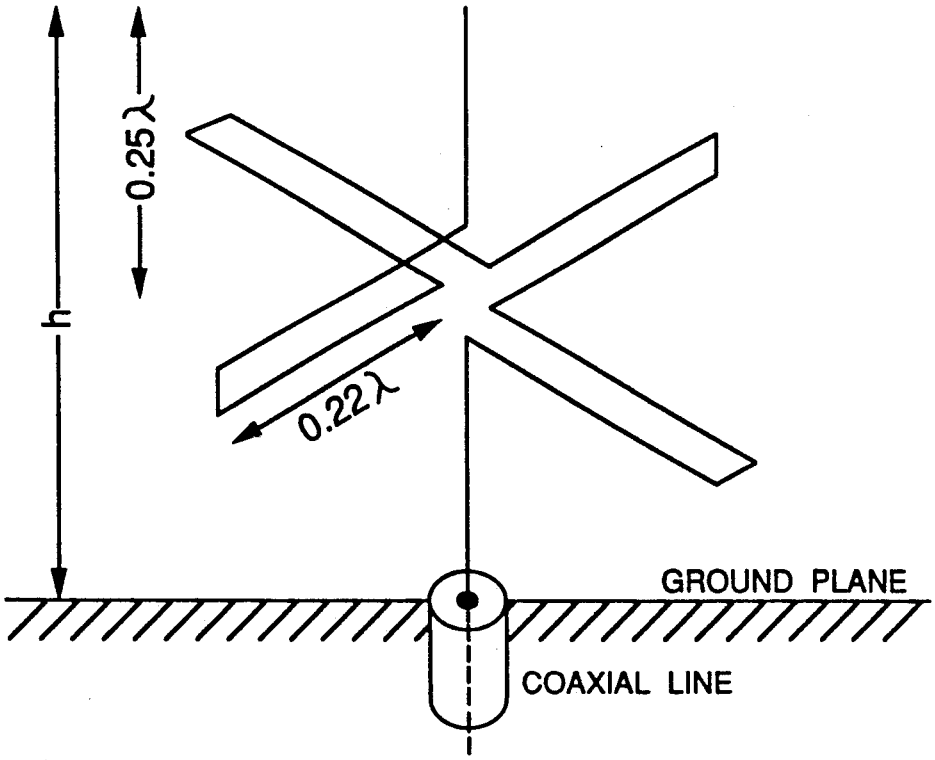
FIG. 3 is a series fed double folded monopole.

A simple type of antenna to use in place of the resistor is the modified folded dipole of FIG. 1B, or the modified double-folded dipole of FIG. 2. The resultant antenna has three radiating elements that are orthogonal with respect to each other as is shown in FIG. 2. The monopole consists of two vertical wires; wire 1 is the input element which is an extension of the center conductor of a coaxial line and wire 7 is the end section of the monopole. The orthogonal modified folded dipoles each consist of five segments. Wire 2 is fed from wire 1; wires 3 and 5 are very short end segments of the folded element; wire 4 is the center segment and wire 6 is the last wire of the folded element which in turn feeds the end section of the monopole, wire 7. The objective is to design these elements so that the currents have comparable magnitudes and are in phase quadrature. If this is possible then near hemispherical coverage should be achievable. There are several ways to control the magnitude and phase of the current. One is the length of the folded element; another is the distance of the folded element above the ground plane; finally the folded element may be fed in parallel as is shown in FIG. 2 or in series as seen in FIG. 3. Also the short segments 3 and 5 may be oriented either parallel to or perpendicular to the ground plane. If the proper current magnitudes and phases cannot be achieved with two folded elements, then three or more folded elements could be considered. The double-folded monopole can be scaled to operate at almost any frequency. The antenna has lateral and vertical dimensions of approximately one-half wave length although the vertical dimension may be made longer depending on the directional properties that are desired.

This antenna will be most valuable for applications which require dual polarization and near hemispherical coverage. However there are other applications for which hemispherical coverage may not be needed. Since the directional properties of this antenna can be controlled by adjusting the monopole height, it is possible to place peaks and nulls in desired directions. For example if a null were desired in the zenith direction, the inserted double-folded dipole would be positioned at a height which is an integral number of half wavelengths above the ground plane. Another advantage is low cost. The double-folded monopole can be easily fabricated out of standard wire. The diameter of the wire is determined by the wavelength of operation; a typical diameter would be about 0.005λ. Also, this antenna is easily driven from a coaxial line. A new feature of this antenna is that one antenna is used to drive other antennas. In this way it is possible to drive several antennas from a single input.

In addition to the double-folded monopole that has been described, there are many other options. For example it is possible to stagger the inserted elements so that they are an odd number of quarter wavelengths from the end of the monopole. Also, other multi-folded elements, i.e. triple-folded or quadruple-folded insertions may be used. It may also be possible to insert helical elements rather than folded elements. Since the directional properties of the double-folded monopole are a strong function of the height of the monopole the antenna pattern can be easily changed by telescoping the height of the monopole. Thus azimuth and elevation coverage can be controlled. Also, this antenna can be operated at other frequencies if both the vertical and horizontal elements are telescoped.

Figure 4:
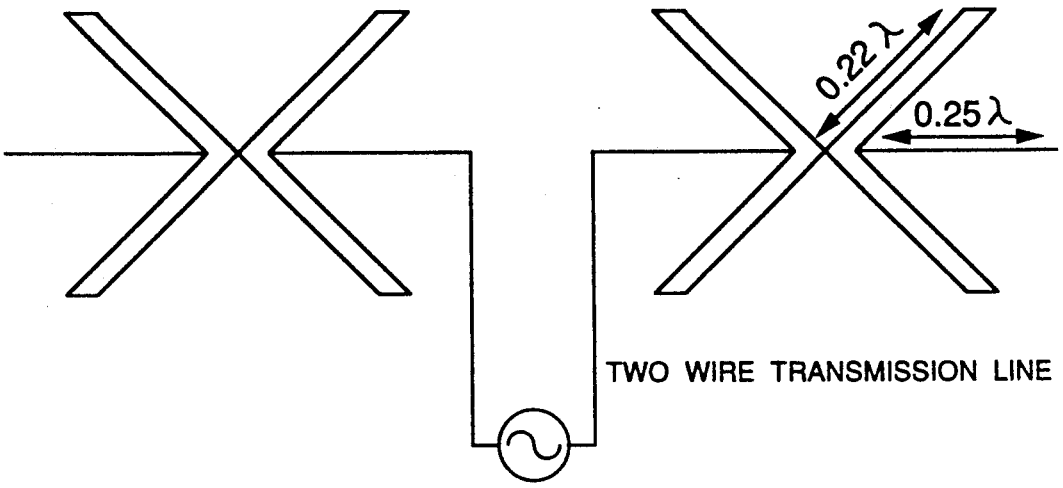
FIG. 4 is a illustration of a double folded dipole antenna.
Figure 5:
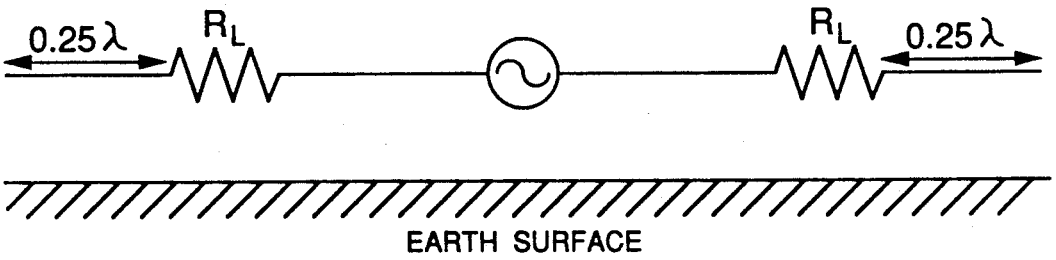
FIG. 5 is an illustration of a wave antenna.
Figure 6:
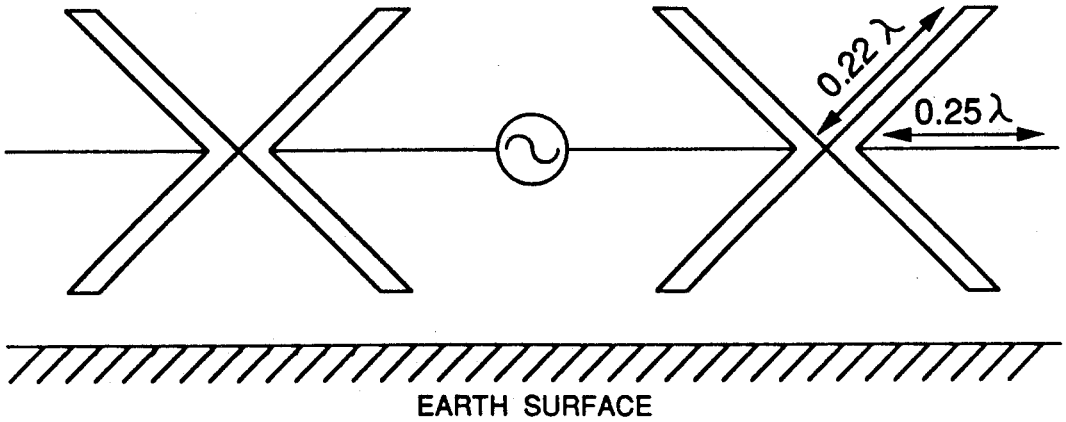
FIG. 6 is an illustration of a double-folded wave antenna.

A monopole over a ground plane is equivalent to a dipole in free space. Thus all of the designs that have been previously described could use a dipole configuration. For example a double-folded dipole is shown in FIG. 4. The dipole is driven by a two-wire line. Each of the modified double-folded elements are inserted one quarter wavelength from the end of each of the dipole arms. This antenna should approach omnidirectional coverage for both horizontal and vertical polarization. Another option is to insert modified double-folded dipole elements in a wave antenna (3) in place of the resistors. The wave antenna is a traveling-wave horizontal wire antenna over the earth as is shown in FIG. 5. The crossed modified folded dipoles should enhance the field along the surface of the earth and also provide a horizontally polarized field in addition to the vertically polarized component. The double-folded wave antenna is shown in FIG. 6.

The double-folded monopole can be designed to operate at any frequency in the range from about 1 MHZ to 10 GHZ. It can be used for any military application that requires a dual polarized antenna with near hemispherical coverage. It may be used as a single element or as an array element.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A double folded monopole antenna comprising:
a ground plane;
a monopole stud with a center axis and an outer end which extends above and is perpendicular to said ground plane; and
double fold radiating elements which are electrically connected and fixed to said monopole stud, wherein said double fold radiating elements comprise: a first and second V-shaped radiating fold which have points of their V-shapes in contact respectively with each other so that the first and second V-shaped radiating folds form a double folded shape that resembles an X with said X having a center aligned with the center axis of the monopole stud, wherein the center of the double folded shape that resembles an X is located on said monopole stud at a distance equalling one-quarter wavelength from the outer end of the monopole stud.

2. A double folded monopole antenna, as defined in claim 1, wherein said double fold radiating elements project out sideways from said monopole stud to a distance which extends approximately one-quarter wavelength on either side out from said center axis of said monopole stud.

3. A double folded monopole antenna comprising:
a ground plane; and
a monopole stud with a center axis and an outer end which projects through, extends above and is perpendicular to said ground plane, and wherein said monopole stud is formed from a continuous antenna wire which is bent in folds to form four half-fold radiating elements which are parallel to each other on either side of said axis and electrically connected and fixed to said monopole stud at about one-quarter wavelength from the outer end of the monopole stud.

4. A double folded monopole antenna, as defined in claim 3, wherein said half-fold radiating elements project out from said monopole stud to a distance which extends approximately one-quarter wavelength from said center axis of said monopole stud.

5. A double fold dipole antenna, for outputting the signal generated by a signal source, said double folded dipole antenna comprising;
first and second monopole studs which are each electrically connected to the signal source;
first and second double fold radiating elements which are respectively electrically connected and fixed to the first and second monopole studs, wherein the first and second double fold radiating elements each comprise a first and second V-shaped radiating fold which have the points of their V-shapes in contact with each other so that the first and second V-shaped radiating folds form a double folded shape that resembles an X with said X having a center aligned with a center axis of the first and second monopole studs; and
a two wire transmission line that connects the first and second monopole studs to the signal source.

6. A double fold dipole antenna, for outputting the signal generated by a signal source, said double folded dipole antenna comprising:
first and second monopole studs which are each electrically connected to the signal source; and
first and second double fold radiating elements which are respectively electrically connected and fixed to the first and second monopole studs, wherein the first and second double fold radiating elements each comprise a first and second V-shaped radiating fold which have points of their V-shapes in contact with each other so that the first and second V-shaped radiating folds form a double folded shape that resembles an X with said X having a center aligned with a center axis of the first and second monopole studs.

* * * * *